United States Patent [19]

Bekker-Madsen et al.

[11] Patent Number: 4,828,408

[45] Date of Patent: May 9, 1989

[54] APPARATUS FOR PRINTING AN INFORMATION CARRIER

[75] Inventors: Per Bekker-Madsen; Otto H. Christensen, both of Vojens, Denmark

[73] Assignee: Uniprint A/S, Vojens, Denmark

[21] Appl. No.: 192,585

[22] Filed: May 9, 1988

[30] Foreign Application Priority Data

May 9, 1987 [DE] Fed. Rep. of Germany ..... 3715523

[51] Int. Cl.[4] ..... B41J 3/02

[52] U.S. Cl. ..... 400/120; 400/231

[58] Field of Search ..... 400/120, 241.1, 241.2, 400/231, 218; 346/76 PH; 219/216 PH

[56] References Cited

U.S. PATENT DOCUMENTS

| | | | |
|---|---|---|---|
| 4,329,071 | 5/1982 | Applegate et al. | 400/120 |
| 4,387,380 | 6/1983 | Asakura et al. | 346/76 PH |
| 4,507,667 | 3/1985 | Tsuboi | 346/76 PH |
| 4,532,524 | 7/1985 | Yawa et al. | 346/76 PH |
| 4,561,789 | 12/1985 | Saito | 400/120 |
| 4,609,926 | 2/1986 | Aviram | 400/120 |
| 4,647,233 | 3/1987 | Noda et al. | 400/120 |
| 4,707,707 | 11/1987 | Ohno | 346/76 PH |
| 4,768,041 | 8/1988 | Sato et al. | 346/76 PH |

*Primary Examiner*—Eugene H. Eickholt
*Attorney, Agent, or Firm*—Peter K. Kontler

[57] ABSTRACT

In a transfer printer, the printed, ribbon-like information carrier is suddenly separated from the printing ink ribbon 1 to 5 mm after the two ribbons have passed the transfer pins. Separation is gently initiated over a brief length before this.

11 Claims, 3 Drawing Sheets

APPARATUS FOR PRINTING AN INFORMATION CARRIER

Figure 1:
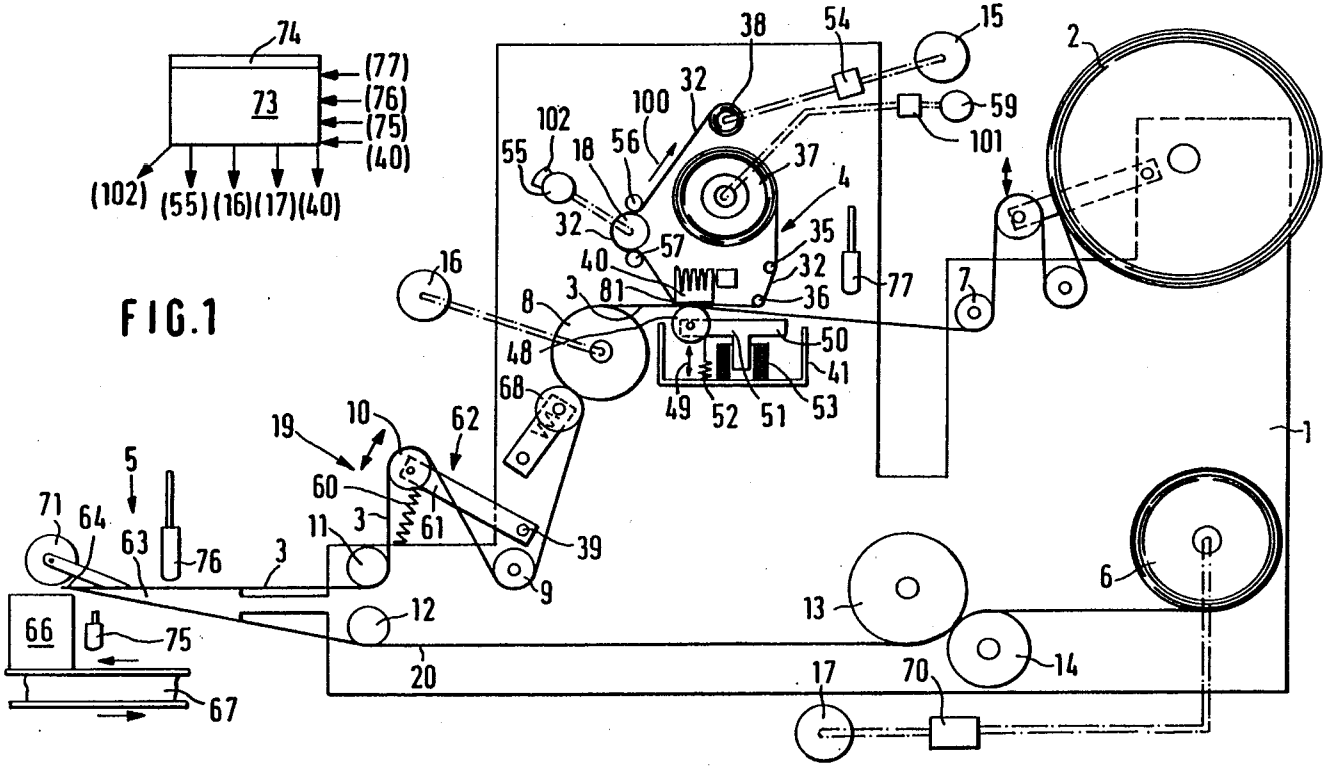

The invention relates to an apparatus for printing an information carrier with a transfer printer writing with meltable printing ink having a printing head with a printing plate, whose end face is a printing surface, in which is arranged a straight line of electrically selectively heatable transfer pins, with a printing ink ribbon comprising a heat-resistant carrier band coated on one side with meltable, hardened printing ink, with a pressing element, which is positioned opposite the printing plate and extends along the line of transfer pins, with drive means for the information carrier and for the printing ink ribbon, with guide means for guiding the information carrier and carrier band separately to the pressing element, at equal speed and in combined form between the printing surface and pressing element, namely the carrier band on the side of the printing surface with the printing ink coating and facing the information carrier and separately away from the pressing element and with a pressure loading for the pressing element as a result of which the latter presses the information carrier against the printing ink ribbon and with the latter against the transfer pins.

Using a transfer printer of the present type a line of melted printing ink is transferred to a paper led under and passed a heated transfer pin and which hardens to a non-smearable or non-obliteratable print application. If a transfer pin is heated for a long time, then it writes a line in the feed direction of the label band, whilst if the transfer pin is only briefly heated it writes a dot and with such dots it is also possible to write characters in the screen. Such a transfer printer is particularly suitable for recording the bar code normally used for identifying goods. For the thin line one transfer pin is heated, for a medium thick line two adjacent transfer pins and for the very thick line three adjacent transfer pins are simultaneously heated and in the corresponding manner it is also possible to print even wider lines. The transfer pins are so closely juxtaposed that the lines printed by adjacent transfer pins are adjacent to one another or coalesce in the completed printing.

The problem of the invention is to so construct an apparatus of the aforementioned type that it can be operated at an optimum high printing speed.

The invention is characterized in that the outgoing length of the information carrier extending from the end of the line of transfer pins to the complete transfer of the printing ink by separating the information carrier from the printing ink ribbon is 0.2 to 5 mm (millimeters), preferably 1.5 mm and that the portions of the printing ink and information carrier participating in the printing are in each case guided so rapidly over the outgoing length that the transferred printing ink is still soft on completing separation.

The short outgoing length also makes it possible to limit the consumption of printing ink ribbon, as will be explained in greater detail hereinafter. This is important because printing ink ribbon is costly expendable material.

The short outgoing length and the separation of the information carrier from the printing ink ribbon whilst the printing ink is still warm makes it possible to operate the apparatus at a very high printing speed.

The rapid printing ink transfer to the information carrier sought by the in each case heated transfer pins is aided in that the facing surfaces of the carrier band and information carrier, the printing ink and the transfer pins and their heating are so matched to one another that the portions of the printing ink made soft by the heated transfer pins have a greater affinity for the information carrier than for the carrier band.

It has been found that in this way not only can the information carrier be rapidly moved passed the transfer pins during print operation, but also a very precise sharp contour printing is obtained.

Particularly good results are obtained with a construction such that after completing 10 to 70% (percent), preferably 50% of the outgoing length the pressing element exerts no further pressure on the printing ink ribbon.

The first portion of the outgoing length gives the printing ink time to form the affinity-caused adhesion on the information carrier. In the second part of the outgoing length slowly the detachment of the printing ink from the printing ink ribbon is initiated. As a result of this initiation, it is then possible to rapidly carry out the final separation. This has also proved to be appropriate for a precise, rapid and final ink transfer. A corresponding construction which takes account of this is characterized in that at the end of the outgoing length there is an edge on the printing head round which the printing ink ribbon is conveyed at an angle of 3° to 42° (degrees), preferably 38.5° inclined with respect to the information carrier.

The extent with which the separation is initiated in the second portion of the outgoing length can be correspondingly optimized to the operating conditions and in the simplest way by adjusting the direction with which the information carrier is removed from the pressing element. A correspondingly preferred construction is characterized in that the printing ink ribbon following onto the transfer pins is guided closely along the printing surface, that the information carrier is removed from the pressing element in the vicinity of the outgoing length in such a way that the information carrier forms an acute angle of 0.7° to 30°, preferably 1.5° with the printing surface opened in the conveying direction of the printing ink ribbon, so that for the remainder of the outgoing length of separation from the printing ink ribbon and the information carrier is brought about, but which is bridged up to the end of the outgoing length by expanding the printing ink layer.

It is also possible to favour on the infeed side the performance of the printing process and therefore also the printing speed. A corresponding preferred solution is characterized in that the information carrier is moved up to the pressing element in such a way that the information carrier forms an acute angle of 2° to 30°, preferably 10.5° with the printing surface and which is open against the feed direction of the printing ink ribbon and that the printing ink ribbon is moved tangentially up to the pressing element in an acute angle to the printing surface, which is roughly half as large as the acute angle of the information carrier and is preferably 5%.

For apparatuses of the aforementioned type the printing ink ribbon is very costly and it is therefore a further problem of the invention to restrict the consumption of said ribbon.

This problem is solved in that during the advance of the information carrier the drive for the printing ink ribbon takes place at the same speed and in the forward direction only during printing operation during which portions of the information carrier to be printed are moved passed the transfer pins and the outgoing length, that during blank operation, i.e. the operating time during which the information carrier is advanced and no printing operation takes place, the printing gink ribbon is not advanced and that only in the case of printing operation is the pressing element pressed against the information carrier and against the printing ink ribbon, whereas it is raised from the information carrier during blank operation.

Whereas in the case of known apparatus of the aforementioned type the printing ink ribbon constantly also revolves, so that just as much printing ink ribbon is consumed as length of information carrier travels passed the printing head, according to the invention the printing ink ribbon length consumption corresponds to the summated, actually printed portions of the information carrier, plus the length of the outgoing part and possibly provided tolerance portions.

Printing ink ribbon loss corresponding to the outgoing part length is initially unavoidable, because in the case of printing operation the ribbon must be moved in the same direction as the information carrier until the transferred printing ink has been completely transferred to the information carrier and this only takes place at the end of the outgoing length. The shorter the outgoing length, the smaller the resulting printing ink ribbon loss.

The printing ink ribbon loss caused by the outgoing length and possible tolerance portions can be reduced in that the printing ink ribbon drive immediately following onto a printing operation and prior to the start of the next printing operation conveys the printing ink ribbon rearwards until the start of the printing ink portion unused at the end of the preceding printing operation is under the transfer pins and also in that the printing ink ribbon is stationary during blank operation.

In the case of such a transfer printer the maximum speed with which the paper to be printed, together with the printing ink ribbon is moved passed the printing head during the printing process is limited. On exceeding this maximum speed, printing becomes unclean.

In the sense of the aforementioned set problem the time with which an information carrier is printed can be reduced in that the drive for the information carrier during printing operation takes place with a first, slow printing speed and at the same speed as the printing ink ribbon and during the blank operation takes place with a second speed which is higher by a multiple and that only in the case of a printing operation is the information carrier pressed against the printing ink ribbon, whereas this is not the case with blank operation.

In most information carriers there are gaps between the inscriptions where no printing ink has to be transferred to the information carrier. During these times, the so-called blank times, the information carrier can be moved passed the printing head at a speed higher than the printing speed without impairing the printing quality.

In order that during blank operation the information carrier does not rub off printing ink from the sationary printing ink ribbon, pressing is discontinued during this.

It is to be ensured that a desired printing image is obtained in perfect form over the entire surface. The upstream and downstream ends of the printing image are critical. Account can be taken thereof by a construction, which is characterized in that printing operation is maintained for a printing time interval starting as soon as a first tolerance portion arrives immediately upstream of a portion of the information carrier to be printing at the transfer pins and ends as soon as a second tolerance portion immediately following the portion to be printed passes by the transfer pins and, based on the information carrier conveying direction, said tolerance portions are 0.2 to 3.0 mm, preferably 1.0 mm.

The invention can be used on the most varied apparatuses where printing takes place, e.g. for ticket printers, typewriters, EDP printers and the like. It is preferably usable in conjunction with a label dispenser or printer for individually successively printing the labels of a label band serving as the information carrier, said label band comprising a carrier band to which detachably adhere labels in uniformly lined up manner, which are of equal size and have adhesive on the back, said labels being individually successively dispensed in printed form.

In the case of such a label band no pressure is required between the individual labels and the printing field never extends over the entire surface of the label, so that long portions are available for blank operation. In general a very high printing speed is desired, so that in the time unit sufficient printed labels are available.

The invention is usable in an apparatus which, if necessary, for example in the case of pressing a button, in each case dispenses a printed label, a printed ticket or the like, which can then e.g. be manually removed. The invention is preferably usable in conjunction with a labelling machine, in which the transfer printer is followed by a label dispenser equipped with dispensing tongue. This label dispenser can be directed on a product conveyor belt and by clock signals of the latter dispenses a label for each passing product, the label being removed from the dispensing tongue and pressed by means of a roll on the product. In the case of such labelling machines the dispensing cycle for the labels on the label dispenser is determined by the cycle of the products moved passed. The product conveying speed is in certain circumstances very high and the dispensing speed with which the label dispenser dispenses a label must be equally high. In accordance with the product cycle speed there is a pause between the labels to be dispensed.

The dispensing speed predetermined by the product conveying speed is generally much higher than the printing speed of a transfer printer. However, the use of a transfer printer in the case of such a label conveyor is made possible in that a label band store is provided between the transfer printer and the label dispenser, which can receive a storage loop of the label band with some printed labels. It is therefore possible to operate the transfer printer with a higher clock frequency with a lower printing speed and therefore to obtain the number of labels required for the label dispenser operated at a higher dispensing speed, but a lower timing sequence. It is particularly favourable for the dispensing capacity of the transfer printer if, according to the aforementioned further development on the transfer printer the label band is only operated during printing operation at printing speed, but otherwise at the higher blank speed.

Generally apparatuses of the present type are always operated continuously with the same labels, which are always printed in the same way, in each case over a longer operating portion. This makes it possible from the outset and in accordance with the label length and the arrangement of the printing image on the labels to preprogram the switching in and over of the drives to the different speeds. A corresponding further development is characterized in that there is a program control means for the drives, that label feelers are provided in the path of the labels and/or the products to be labelled, whose signals pass to the program control means and that one or more stepping motors are provided as drive means.

For all these drives it is possible to have a single drive motor and to derive the different speeds from the same via different clutches and transmission gears. However, it is simpler to provide for the different drive problems in each case a separate drive and due to the cyclic operation it is advantageous to use an electric stepping motor. This more particularly applies for the label dispenser, with which is preferably associated a stepping motor independent of the transfer printer drive.

The invention will now be described in greater detail relative to the drawings, wherein show:

FIG. 1: viewed from side, a labelling machine in blank operation.

Figure 2:
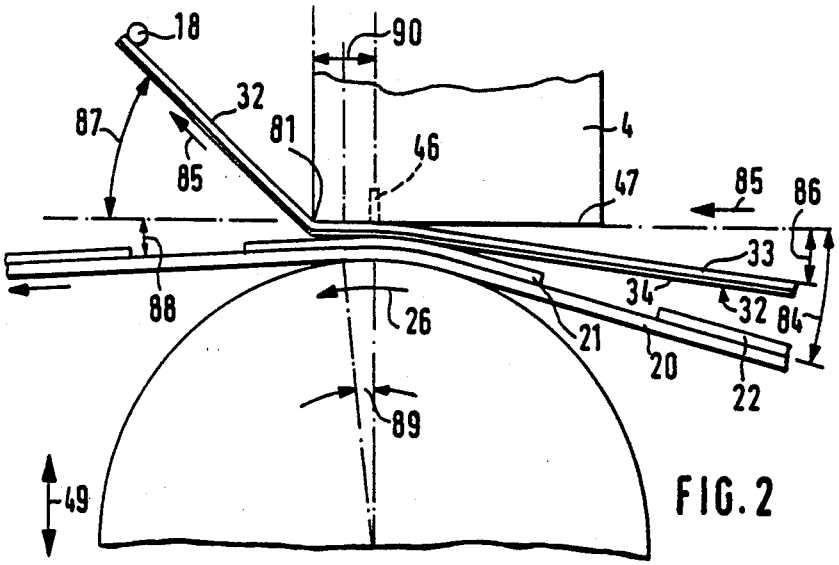

FIG. 2: the printing head with the printing substrate of FIG. 1, shown on a larger scale, in each case in printing operation and with further details.

Figure 3:
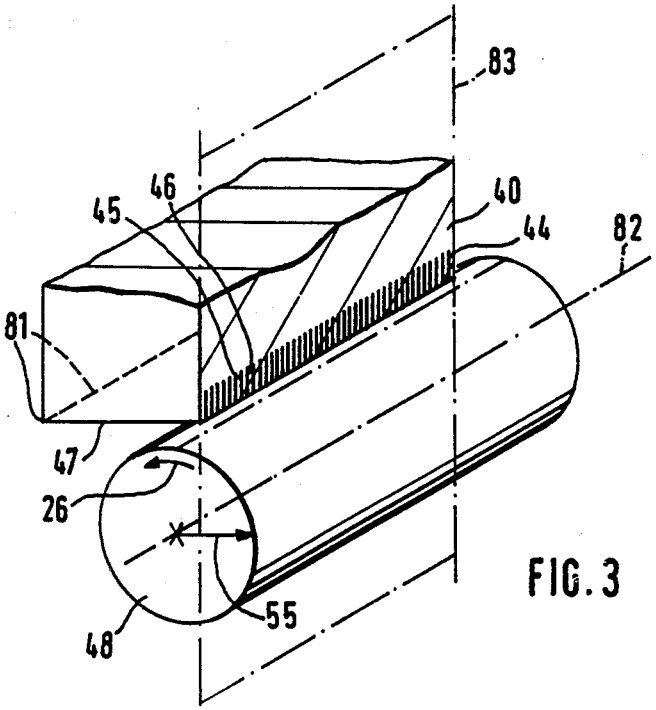

FIG. 3: parts of FIG. 2 in perspective form.

Figure 4:
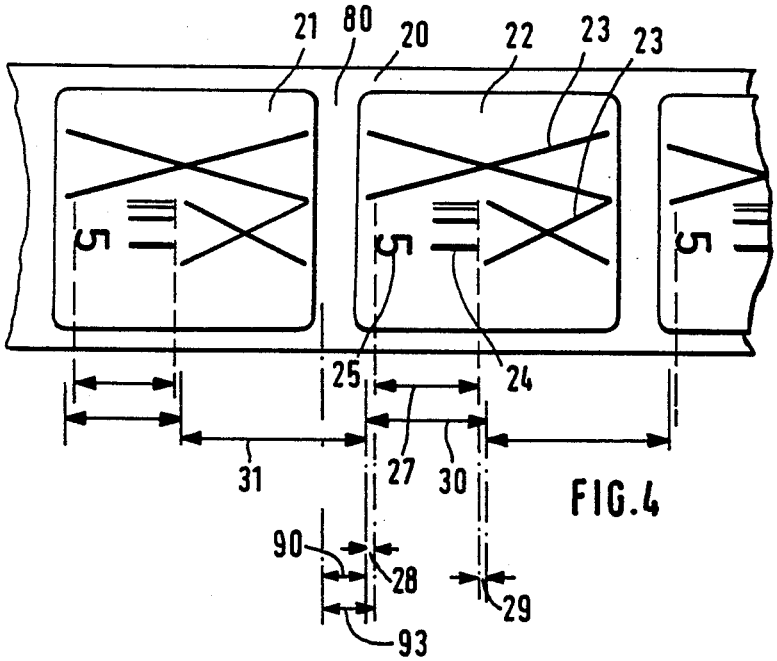

FIG. 4: viewed from above, a portion of the label band with two completely printed labels.

FIG. 5: a graph.

In the drawings 1 is a casing on which are mounted a storage spool 2 for the label band 3 serving as information carrier, a transfer printer 4, a label dispenser 5, a winding spool 6 for the carrier band freed from labels, various rollers 7 to 14 and 18 for guiding the label band 3 and drive motors 15,16,17, which are concealed in the drawing, but are not shown for reasons of clarity.

According to FIG. 2, the label band 3 comprises a carrier band 20, to which detachably adhere with a uniform spacing 80, lined up, equally large labels 21,22 with adhesive on the back. The labels are made from paper and are preprinted on their exposed front side, e.g. with a coloured impression 23, indicated by crosses in FIG. 4.

In accordance with the product to be labelled, the labels are not printed e.g. with a product code corresponding to bar code 25 and the figure 25 in FIG. 4. The printed image is the same for each label and is also positioned in the same way.

The label portion to be printed, based on the feed direction according to the label a band arrow 26 is defined by the double arrow 27. This area is followed in the feed direction in front by a first tolerance portion 28 and to the rear by a second tolerance portion 29. These two tolerance portions, plus the portion corresponding to double arrow 27 give the printing portion according to double arrow 30 and between them there are blank portions according to double arrow 31.

32 is a printing ink ribbon, which comprises a heat-resistance carrier band 33 coated on its underside facing the label band 3 with thermoplastic, hardened printing ink 34. The zones of the printing ink 34 made warm and soft by heating have a higher affinity to the surface of the labels 21,22 to be printed than to the carrier band 33, so that the softened printing ink zones, if pressed against the labels are transferred to the latter. This will be explained in greater detail hereinafter relative to FIGS. 4 and 5.

For the printing ink ribbon 32 the casing 1 carriers two guide rollers 35,36, a drive roller 18 with associated feed rollers 56,57, a guide edge 81, a storage spool 37 and a winding spool 38 for the consumed printing ink ribbon. Interposed between the drive motor 15 and the winding spool 38 is a friction clutch 54. Drive motor 15 drives the printing ink ribbon 32 in arrow direction 100. For the storage spool 37 is provided a drive motor 59 with an interposed slip clutch 101. Drive motor 59 drives the storage spool 37 rearwards, i.e. counter to arrow direction 100. The two drive motors 15 and 59 with the associated friction clutches 54 and 101 serve to keep the printing ink ribbon taut. The forward or rearward movement of the printing ink ribbon is determined by drive 55 which drives the drive roller 18. Drive 55 can drive forwards or rearwards or stop the drive roller 18. The printing ink ribbon 32 loops round the drive roller 18 as a result of the two spring-loaded, engaging feed rollers 56,57, which ensure that the printing ink ribbon precisely always moves with the circumference of the drive roller 18. An engagable and disengagable brake 102 also acts on drive roller 18.

40 is a printing head of the transfer printer 4, which faces a print substrate means 41.

Label band 3 is moved between the printing head 40 and the print substrate means 41 with the carrier band facing said means 41. The printing ink ribbon 32 is guided between the label band and the printing head with the printing ink coating 34 facing the label band. The printing head 40 of the transfer printer 4 has a row or line 44 of electrically selectively heatable transfer printer pins 45,46, etc. This row 44 extends at right angles over the entire width of labels 21,22 and at right angles to the feed direction according to arrow 26. There are e.g. three transfer pins over a 1 mm row length.

The lower face of the printing head forms the flat printing surface 47. With 2 to $3.10^{-2}$ mm, the free ends of the transfer pins 45,46 project out of the printing surface 47. Facing the printing surface 47 is provided a pressing roller 48 of the print substrate 41. The pressing roller is rotatably mounted and extends with its axis 82 parallel to the row 44 of transfer pins. The circumference of the pressing roller is elastic and has a diameter of 4 mm. The so-called transfer plane 83 defined by axis 82 and row 44 extends at right angles to printing surface 47. During printing operation the pressing roller faces printing surface 47 in the printing position shown in FIGS. 2 and 3 and presses the label band 3 and printing ink ribbon 32 against the printing surface, so that the heat of the heated transfer pins becomes effective and can melt the portion of the printing ink located directly below the same, which is then transferred to the paper of the labels and subsequently, after the label band has been further transported, hardens to give the desired printing image.

The pressing roller 48 is mounted on a carrier pair 51 pivotable about an axis 50 parallel to the roller axis in the direction of double arrow 49. On the carrier pair engages a tension spring 52 and an electromagnet 53, shown in deactivated form in FIG. 2, so that the pressing roller is drawn back into its blank position where it no longer presses on the label band, so that the latter is detached from the printing ink ribbon. If the electromagnet 53 is activated, then the pressing roller 48 moves into its printing position shown in FIGS. 2 and 3, where it presses the label band against the printing ink ribbon and printing surface 47.

As can be particularly clearly seen in FIG. 2, as a result of the position of roller 7, the label band 3 is tangetially moved up to the pressing roller in the printing operation position, so that the label band forms with the printing surface 47 an acute angle 84 of 10.5°, which is open against the feed direction according to arrow 85 of the printing ink ribbon. The alter is simultaneously moved up tangentially in an acute angel 86 to the printing surface, said angle being roughly half as large as the angle 84 and in the present case 5°.

Following onto the transfer pin 45,46, the printing ink ribbon 32 is moved closely along the printing surface 47 and namely up to edge 81 on the downstream end of the printing surface, which extends at right angles to the feed direction arrow 85 and parallel to row 44. This edge has a small radius of curvature of approximately 0.1 mm and is constructed as a sliding edge. Around said edge of the printing ink ribbon is drawn off in upwardly sloping manner to roller 18, so that it is conveyed with the printing surface 47 in an angle 87 of 38.5° inclined to the label band 3. Angle 87 is open in the feed direction.

After passing the transfer pins 45,46, the label band 3 loops round the pressing roller 48 for a small portion according to arrow 89 and leaves same tangentially in a direction in which it forms an acute angle 88 of 1.5° with the printing surface 47. The distance measured in the feed direction according to double arrow 90 between the end of the transfer pins 45,46 and edge 81 amounts to 1.5 mm. The length of the label band corresponding to said distance is called the outgoing length 90.

At the end of the outgoing length, i.e. at edge 81, printing ink transfer ends. In other words, the transfer of the printing ink from the printing ink ribbon to the label provided for the sought printing is completed there.

The portions of the ink ribbon and information carrier participating in the printing are guided so rapidly over the outgoing length that the transferred printing ink is still soft when separation is completed. The facing surfaces of the carrier band and information carrier, the printing ink and the transfer pins, as well as their heating are so matched to one another that the portions of the printing ink made soft by the heated transfer pins have a greater affinity to the information carrier than to the carrier band. This ensures that on passing edge 81 the necessary printing ink transfer is completed.

Figure 5:
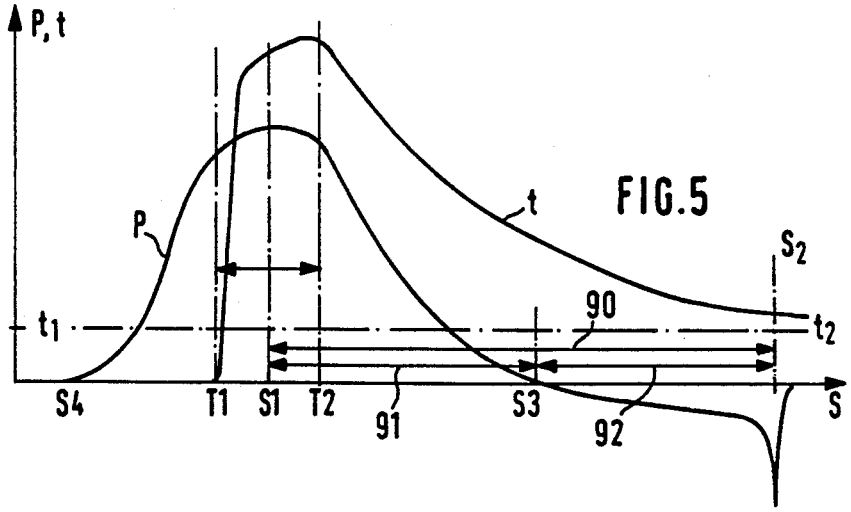

The radius, the pressure loading during printing operation and the elasticity of the pressing roller 48 are dimensioned in such a way that after 30 to 70%, in the present case 50% of the outgoing length, i.e. point S3 in FIG. 5, no further pressure is exerted by the pressing roller 48 on the printing ink ribbon 32. Since, unlike in the known apparatuses, it is not necessary to wait with the separation of the label and printing ink ribbons until the transferred printing ink has hardened, during printing operation said two ribbons can be driven at a higher speed than in the known apparatus.

During printing operation the pressure and temperature configuration of FIG. 5 is obtained. In FIG. 5 the pressure P is plotted on the vertical axis with which the pressing roller 48 acts from below on the label band 3 and presses same with the printing ink ribbon 32 against the printing surface 47 or transfer pins 45,46. On the vertical axis is plotted the temperature t, which can be assumed by those zones of the printing ink which are transferred to the labels during the printing process. Above the temperature t1 the printing ink is soft and the affinity thereof to the surface of the labels to be printed is much greater than with respect to the carrier band.

On the vertical axis is plotted the path S of the label band 3. Point S1 corresponds to the centre of the transfer pins and point S2 to the edge 81. The outgoing length extends from S1 and S2 and S3 marks the centre of the outgoing length 90. S4 is a point which is just as far from S1 as S3, but on the infeed side. Transfer pins 45,46 extend from point T1 to T2.

The temperature rises steeply on passing heated transfer pins, i.e. at T1 and then slowly decreases after leaving the transfer pins at T2. At the end of the outgoing length, i.e. at point S2, the temperature of the printing ink zones to be transferred is still above t1.

In the case of the printing operation the printing action of the pressing roller 48 starts at S4 and rises. At T4 the transfer pins come into operation. When they are heated the printing ink is heated. The affinity of the printing ink to the carrier band 33 decreases in the heated state and the affinity of the printing ink to the label surface increases. Therefore the printing ink adheres to the label surface and loses its adhesion to the carrier band. Simultaneously the pressure rises to a maximum at S1, so that said transfer is assisted. The pressure has dropped somewhat at T2 and heating is ended. Pressure drops further and the printing ink has time to develop its affinity-caused adhesion to the label surface. The pressure exerted by the pressing roller is 0 to S3. During the further movement of the label band, it is increasingly lifted from the printing ink ribbon 32 in the downwards direction, because it still engages on the pressing roller 48, due to angle 88 or 89. Therefore the transferred printing ink, which has a higher affinity for the label surface than for the carrier band is drawn to the latter and is increasingly dissolved there. The resulting tension leads to a slightly increased vacuum. At S2 the printing ink ribbon passes into the vicinity of the guide edge 81 and is removed suddenly from the label band. The transferred printing ink is now torn from the printing ink ribbon at the carrier band, which leads to brief vacuum peaks at S2 and then the information carrier is pressureless.

In portion 91 the printing ink is pressed and in portion 92 the detachment of the transferred printing ink from the carrier band is gently prepared, so that the fading away on edge 81 takes place suddenly and in a precise manner.

Roller 10 is mounted on a lever 61 pivotably mounted about the axis of roller 39 and loaded by a compression spring 60. Label band 3 is guided over rollers 9,10 and 11 in the form of a storage loop 62, which is always kept taut by the spring loading of compression spring 60 of roller 10 and can store 5 to 9 label lengths. Following onto said label band store 19 the label band passes to a dispensing tongue 63 of the label dispenser 5, where it is moved back in U-shaped manner with a small radius, so that the individual labels, such as e.g. label 64 can be removed from the carrier band 20 as a result of its rigidity. This dispensing tongue is directed on to the surface of product 66 of a product conveyor 67. By means of a pressing cylinder 71 such a removed label is pressed down onto the product 66 moved passes and at the product conveying speed is taken off and attached to the product.

Label band 3 is driven by roller 8 which, as indicated, is coupled to the stepping motor 16. For increasing friction, a spring-loaded feed roller 68 loads the circumferential portion looping roller 8. The empty carrier band 20 is driven by roller 13 which, as indicted, is coupled to the stepping motor 17 which, whilst interposing a friction clutch 70, also drives the winding spool 6. The printing ink ribbon 32 is driven by means of the winding spool 38 which, is coupled to the stepping motor 15 for driving purposes.

73 is a program control means, which has a manually operable control console 74 and, a indicated by the arrows, inter alia controls the drive motors 55,16,17 and is controlled by three contactless feelers 75 to 77 and the pushbuttons 40. Feeler 75 operates in the path of the goods 6 to be labelled, feeler 76 is directed onto the printed labels and feeler 77 onto the unprinted labels upstream of the transfer printer 4.

The apparatus operates as follows. The label band 3 is removed from the filled storage spool 2 and namely at a speed given by roller 8. Roller 8 conveys the label band, whilst a blank portion in accordance with double arrow 31 is moved passed row 44 with the blank speed and with the printing speed is moved passed row 44 in accordance with double arrow 30 during a printing portion. The printing speed is e.g. 12 m/min (meters per minute) and the blank speed 18 m/min. Only that label quantity is printed until the storage loop 62 is filled.

On the label dispenser 5, the label band 3 moves at the dispensing speed, which is caused through the driving of roller 13 and is determined by the feed speed of products 66. The label band is advanced stepwise at the label dispenser 5 and a label is in fact dispensed for each step. The dispensing speed is higher than the blank speed and is e.g. 30 m/min.

During printing operation, i.e. the time interval during which its printing portion is moved according to double arrow 30 passed row 44 up to edge 81, the pressing roller 48 is in its printing position shown in FIG. 3.

During the blank operation, i.e. the time interval during which a blank portion is moved passed row 44 in accordance with double arrow 31, or faces row 44 with the label band stationary, the pressing roller 48 is in its functionless blank position shown in FIG. 2.

The printing operation can extend over individual lines an there may be not blank operation between them. However, it can also extend over paragraphs and there is then a blank operation between them. At the end of printing operation, printing ink ribbon is consumed in unused form, in accordance with the tolerance portion 28 of FIG. 4 and the subsequent outgoing length according to double arrow 90, cf. FIG. 4. To avoid this loss, the driving of the printing ink ribbon takes place immediately following printing operation and prior to the start of the next printing operation the printing ink ribbon is conveyed backwards until the start of the printing ink portion unused at the end of the preceding printing operation is located below the transfer pins an the printing ink ribbon is stationary during the blank operation.

For the return guidance of the printing ink ribbon 32, the drive roller 18 is rotated backwards by a corresponding portion and drive motor 15 draws back the printing ink ribbon 32 in corresponding manner. This rearward step 93 corresponds to the tolerance portion 28 plus the outgoing length 90.

During printing operation the printing ink ribbon 32 is moved at the printing speed of the label band 3 in the same direction as the latter, as a result of the drive of the winding spool 38. However, the printing ink ribbon 32 is stationary during the blank operation. Thus, there is no printing ink ribbon consumption during blank operation.

We claim:

1. Apparatus for printing an information carrier with a transfer printer writing with meltable printing ink having a printing head with a printing plate, whose end face is a printing surface, in which is arranged a straight line of electrically selectively heatable transfer pins, with a printing ink ribbon comprising a heat-resistant carrier band coated on one side with meltable, hardened printing ink, with a pressing element, which is positioned opposite the printing plate and extends along the line of transfer pins, with drive means for the information carrier and for the printing ink ribbon, with guide means for guiding the information carrier and carrier band separately to the passing element, at equal speed and in combined form between the printing surface and pressing element, namely the carrier band on the side of the printing surface with the printing ink coating and facing the information carrier and separately away from the pressing element and with a pressure loading for the pressing element as a result of which the latter presses the information carrier against the printing ink ribbon and with the latter against the transfer pins, characterized in that the outgoing length of the information carrier (90) extending from the end of the line of transfer pins (45,46) to the complete transfer of the printing ink by separating the information carrier from the printing ink ribbon (32) is 0.2 to 5 mm (millimeters), preferably 1.5 mm and that the portion of the printing ink and information carrier participating in the printing are in each case guided so rapidly over the outgoing length that the transferred printing ink is still soft on completing separation.

2. Apparatus according to claim 1, characterized in that the facing surfaces of the carrier band and the information carrier, the printing ink and the transfer pins, as well as the heating thereof are so matched to one another that the portions of the printing ink softenrd by the heated transfer pins have a greater affinity for the information carrier than for the carrier band.

3. Apparatus according to claims 1 or 2, characterized in that after covering 10 to 70%, preferably 50% of the outgoing length (90,91), pressing element (48) exerts no further pressure on the printing ink ribbon (32).

4. Apparatus according to one of the preceding claims, characterized in that at the end of the outgoing length an edge (81) is provided on the printing heat (40) around which the printing ink ribbon (32) is conveyed at an angle (87) of 3° to 42°, preferably 35.5° in inclined manner to the information carrier (20).

5. Apparatus according to claim 3, characterized in that the printing ink ribbon (32) following onto the transfer pins (45,46) is guided closely along the printing surface (47), that the information carrier (20) is removed from the pressing element (48) in the vicinity of the outgoing length (90) in such a way that the information carrier forms an acute angle (88) of 0.7 to 30°, preferably 1.5° with the printing surface (47) opened in the conveying direction of the printing ink ribbon (32), so that for the remainder of the outgoing length a separation from the printing ink ribbon and the information carrier is brought about, but which is bridged up to the end of the outgoing length by expanding the printing ink layer.

6. Apparatus according to one of the preceding claims, characterized in that the information carrier (20) is moved up to the pressing element (48) in such a way that the information carrier forms with the printing surface (47) an acute angle (84) of 2° to 30°, preferably 10.5°, which is open.against the feed direction (85) of the printing ink ribbon (32).

7. Apparatus according to one of the preceding claims, characterized in that the printing ink ribbon (32) is moved tangentially up to the pressing element (48) at an acute angle (86) to the printing surface (47), which is roughly half as large as the acute angle (84) of information carrier (20) and is preferably 5°.

8. Apparatus according to one of the preceding claims, characterized in that during the advance of the information carrier (20) the drive (55) for the printing ink ribbon (32) takes place at the same speed and in the forward direction only during printing operation during which portions (31) of the information carrier (20) to be printed are moved passed the transfer pins (45,46) and the outgoing length (90), that during blank operation, i.e. the operating time during which the information carrier is advanced and no printing operation takes place, the printing ink ribbon is not advanced and that only in the case of printing operation is the pressing element (48) pressed against the information carrier and against the printing ink ribbon, whereas it is raised from the information carrier during blank operation.

9. Apparatus according to one of the preceding claims, characterized in that the drive (55) of the printing ink ribbon (32) immediately following onto a printing operation and prior to the start of the next printing operation conveys the printing ink ribbon rearwards until the start of the printing ink portion unused at the end of the preceding printing operation is located blow the transfer pins (45,46) and that otherwise the printing ink ribbon is stationary during blank operation.

10. Apparatus according to claim 8, characterized in that the drive (55) for the information carrier (20) during printing operation operates with a first slow printing speed, at the same speed as the printing ink ribbon (32) and during the blank operation with a second, higher blank speed and that only during printing operation is the information carrier pressed against the printing ink ribbon, which is not the case during blank operation.

11. Apparatus according to claim 9, characterized in that in the course of the printing operation the drive (55) for the information carrier (20) operates at a slow first printing speed matching the speed of the printing ink ribbon (32), and at a higher second speed during the blank operation, an in that the information carrier is pressed against the printing ink ribbon only during the printing operation but not during the blank operation.

* * * * *